US006961978B2

(12) United States Patent
Earley et al.

(10) Patent No.: US 6,961,978 B2
(45) Date of Patent: Nov. 8, 2005

(54) DETACHABLE HANDLE ASSEMBLY FOR ROLLING LUGGAGE

(75) Inventors: Melinda Earley, Loxahatchee, FL (US); Long Hoang, Margate, FL (US); Jacqueline N. Miller, Boca Raton, FL (US); Barry Hoberman, Coral Springs, FL (US)

(73) Assignee: Travelpro International, Inc., Boca Raton, FL (US)

( * ) Notice: Subject to any disclaimer, the term of this patent is extended or adjusted under 35 U.S.C. 154(b) by 0 days.

(21) Appl. No.: 10/359,887

(22) Filed: Feb. 6, 2003

(65) Prior Publication Data

US 2004/0154131 A1 Aug. 12, 2004

(51) Int. Cl.[7] ..... A45C 13/22; A45F 5/10
(52) U.S. Cl. ..... 16/406; 16/422; 16/DIG. 25
(58) Field of Search ..... 16/422–428, DIG. 24, 16/DIG. 25, 406, 114.1, 900; 190/115–118

(56) References Cited

U.S. PATENT DOCUMENTS 3,548,906 A * 12/1970 Murphy ..... 383/25
4,112,542 A * 9/1978 Snyder ..... 16/411
5,713,441 A * 2/1998 Chen ..... 190/115
5,722,118 A * 3/1998 Hansen et al. ..... 16/113.1
5,878,853 A * 3/1999 DeRouen et al. ..... 190/116
6,241,415 B1 * 6/2001 Stark ..... 403/17
6,301,746 B1 10/2001 Myers et al. ..... 16/113.1
6,332,242 B1 * 12/2001 Chen ..... 16/113.1
6,360,402 B1 * 3/2002 Crabtree ..... 16/430
6,470,533 B1 10/2002 Comstock
6,508,344 B1 * 1/2003 Lu ..... 190/115
6,530,459 B1 * 3/2003 Lu ..... 190/115
6,578,231 B1 * 6/2003 Godshaw et al. ..... 16/114.1
6,581,246 B1 * 6/2003 Polette ..... 16/429
6,663,363 B2 * 12/2003 Lee et al. ..... 224/578

* cited by examiner

*Primary Examiner*—John B. Walsh
(74) *Attorney, Agent, or Firm*—Sacco & Associates, PA

(57) ABSTRACT

A handle system for removable attachment to an existing handle of a rolling luggage case. The system includes a grasping bar that has a gripping area ergonomically formed for grasping, and a releasable securement structure coupled to the grasping bar. The releasable securement structure is configured for releasably securing the grasping bar to the existing handle of the rolling luggage case at an end thereof distal from the luggage case. A locking mechanism is provided that is operatively associated with the releasable securement structure for locking the grasping bar in two or more pivot positions relative to the existing handle of the rolling luggage.

10 Claims, 14 Drawing Sheets

DETACHABLE HANDLE ASSEMBLY FOR ROLLING LUGGAGE

BACKGROUND OF THE INVENTION

1. Statement of the Technical Field

The invention generally concerns rolling luggage and, more particularly, a detachable handle system for rolling luggage that facilitates ergonomic gripping of telescoping handle assemblies commonly used for such rolling luggage.

2. Description of the Related Art

Rolling luggage has become increasingly popular in recent years. A common configuration for this type of luggage includes a container or case portion that is generally rectangular in shape in which one or more articles can be stored for travel. The container is typically comprised of a top, bottom, front and back panel, and a pair of sidewalls. A wheel assembly is commonly provided to allow the container to be rolled rather than carried. The wheel assembly generally includes a pair of wheels mounted at an interface of the bottom panel and the back panel of the luggage. The orientation of the wheels defines a rolling direction for the luggage that is orthogonal to the axis of rotation for the wheels.

A telescoping handle assembly is generally provided attached to the back panel and the bottom of the case. The telescoping handle assembly has at least one, and usually two, telescoping posts that can extend from the top panel of the container. A cross-member is generally provided at an end of the telescoping post assembly distal from the container and aligned in a plane that is roughly parallel to the back panel. Configured in this way, the handle assembly provides a gripping surface that is generally oriented transverse to the rolling direction and can therefore be uncomfortable to grip for extended periods of time.

In order to solve the foregoing problem, some newer lines of rolling luggage have begun to incorporate handle systems that include a gripping member that is oriented in a direction more closely aligned with the luggage rolling direction. This arrangement reduces fatigue and is more comfortable for most users. For example, U.S. Pat. No. 6,301,746 to Myers et al. describes a system that includes a gripping handle that is oriented in this way.

Despite the advantages offered by the newer luggage lines with their improved handle systems, they suffer from several problems. They are somewhat more expensive to manufacture as compared to conventional handle systems due to the added materials and mechanisms associated with rotating and locking the handles in a suitable position for pushing or pulling. They also require special features to accommodate the stowage of the protruding portion of the handle assembly to avoid damaging the assembly during aircraft loading and unloading operations. Accordingly, such handle systems have generally been made available only on more expensive lines of luggage.

SUMMARY OF THE INVENTION

The invention concerns a handle system for removable attachment to an existing handle of a rolling luggage case. The system includes a grasping bar that has a gripping area ergonomically formed for grasping, and a releasable securement structure coupled to the grasping bar. The releasable securement structure is configured for releasably securing the grasping bar to the existing handle of the rolling luggage case at an end thereof distal from the luggage case. A locking mechanism is provided that is operatively associated with the releasable securement structure for locking the grasping bar in two or more pivot positions relative to the existing handle of the rolling luggage. The pivot positions of the grasping bar can advantageously define a plane that is generally parallel to a rolling direction defined by an orientation of a set of wheels of the rolling luggage case.

According to another aspect, the locking mechanism can have a lock control actuator disposed on a portion of the grasping bar contiguous with a portion of the gripping area and the grasping bar can be pivotally connected to the releasable securement structure. For example, the locking mechanism can have a lock control actuator aligned for operation by a user's thumb when grasping the gripping area. According to one embodiment, the locking mechanism can have a lock control actuator that is a button aligned coaxial to the grasping bar. The lock control actuator can be located at an end of the grasping bar that is distal from the releasable securement structure.

According to another aspect of the invention, the releasable securement structure can be comprised of one or more locking clips configured for locking the releasable securement member to the existing handle in a fixed position. For example, the locking clip can be configured for engaging at least one of the two post members forming the existing handle of the rolling luggage case. According to another embodiment, the locking clip can be configured for engaging a cross-member connecting distal end portions of two post members forming the existing handle of the rolling luggage case. The locking clip can alternatively be configured to engage the existing handle of the rolling luggage in a plurality of orientations for locking the grasping bar in a plurality pivot positions relative to the existing handle of the rolling luggage. The locking clip may, in one embodiment, include a strap and buckle attachment for securing the locking clip to the existing handle of the rolling luggage case.

According to yet another embodiment, the securement structure can be comprised of a rigid frame. The frame can be pivotally attached to the grasping bar, and also attached to an elongated rod dimensioned to engage each of two post members forming the existing handle of the rolling luggage case. The frame can be configured to rest against the cross-member of the existing handle of the rolling luggage case when the elongated rod engages the two post members. A strap can also be attached to the frame. The strap can be extended around the cross-member to secure to a clip provided on the frame.

DETAILED DESCRIPTION OF THE INVENTION

Figures 1A, 1B, 1C:
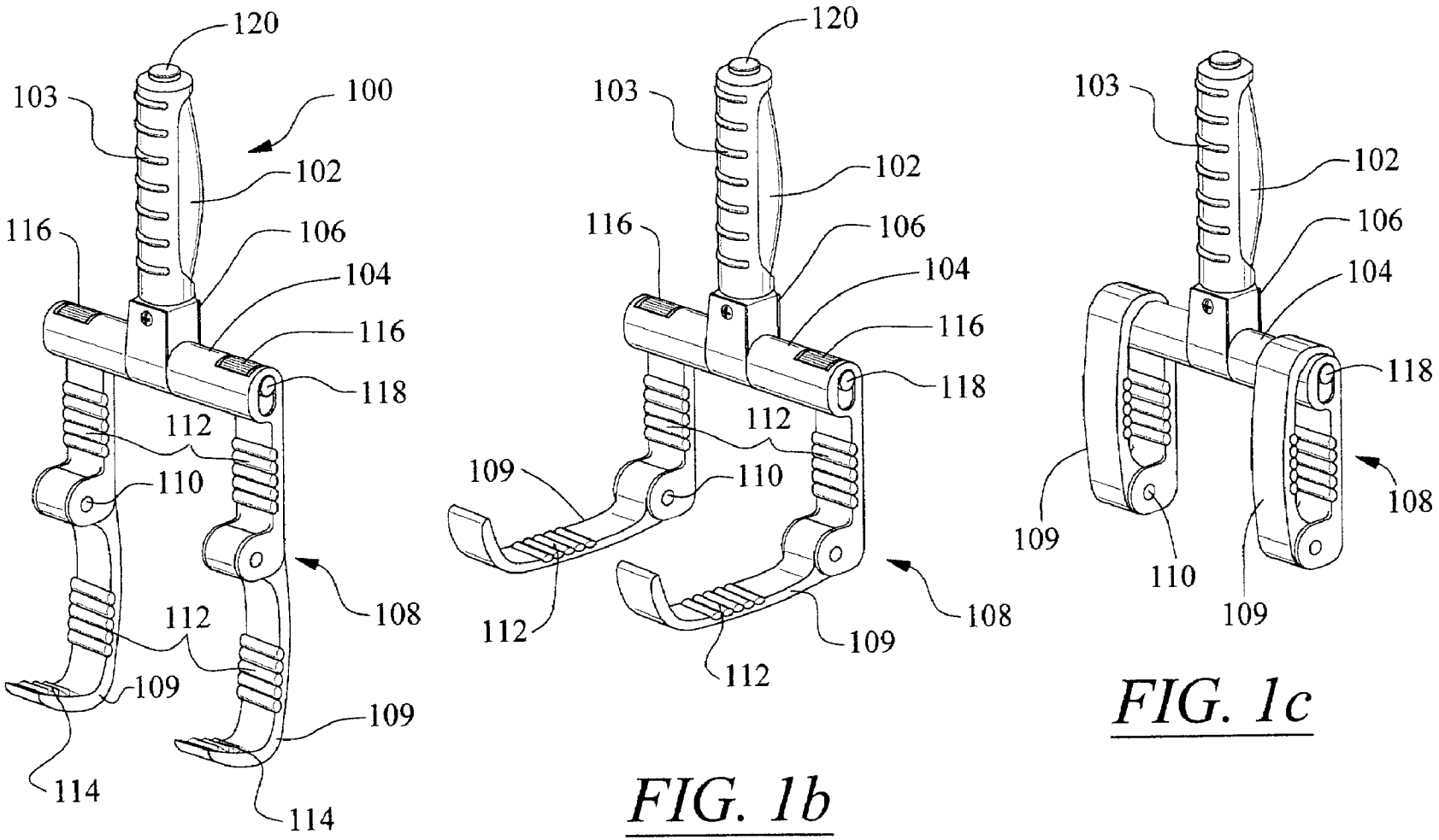
FIGS. 1*a*–1*c* are a series of drawings that are useful for understanding a first configuration of a detachable handle system.
Figures 2A, 2B, 2C:
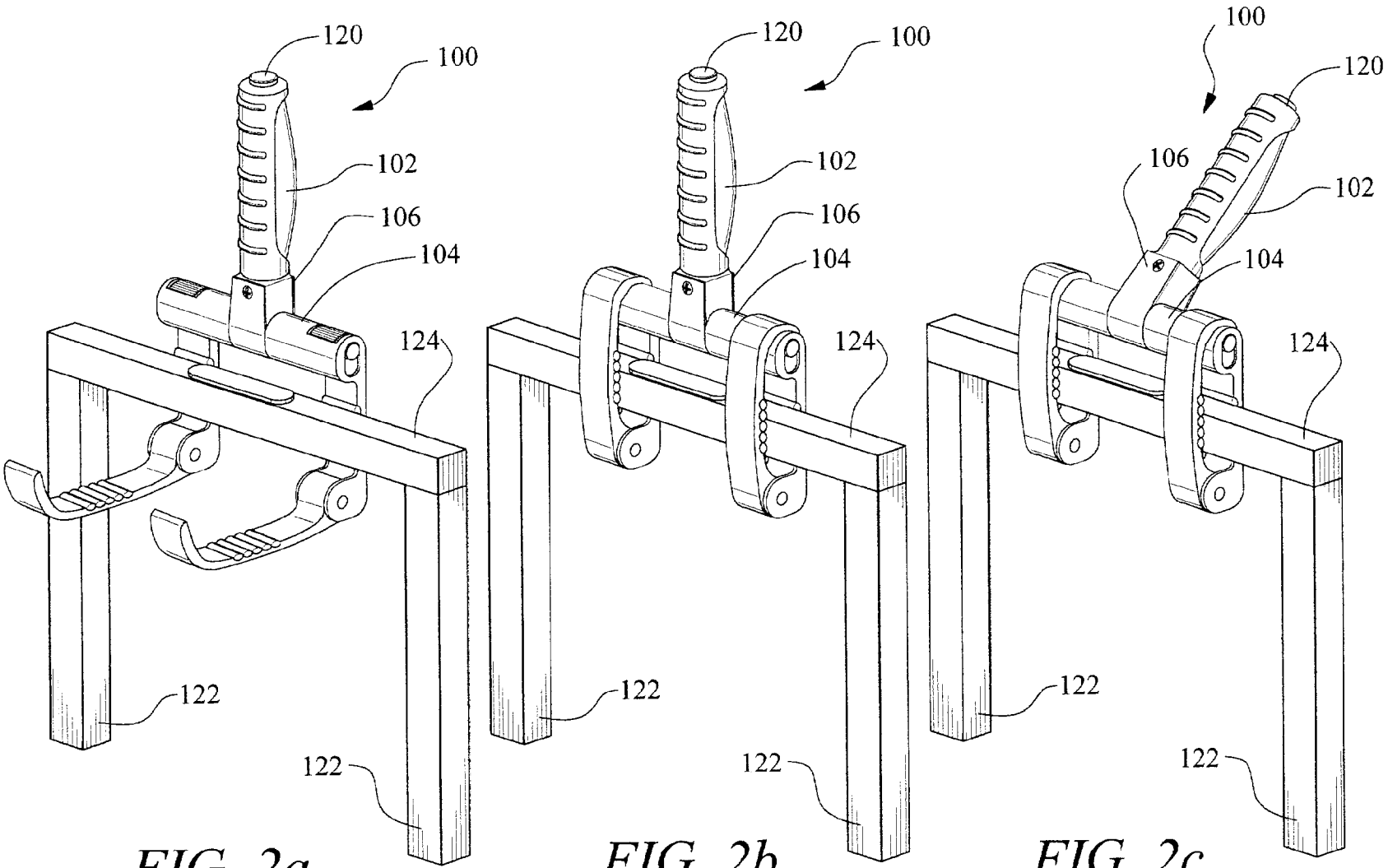
FIGS. 2*a*–2*c* are a series of drawings showing the manner in which the handle system of FIGS. 1*a*–1*c* can be attached to an article of rolling luggage.
Figure 7:
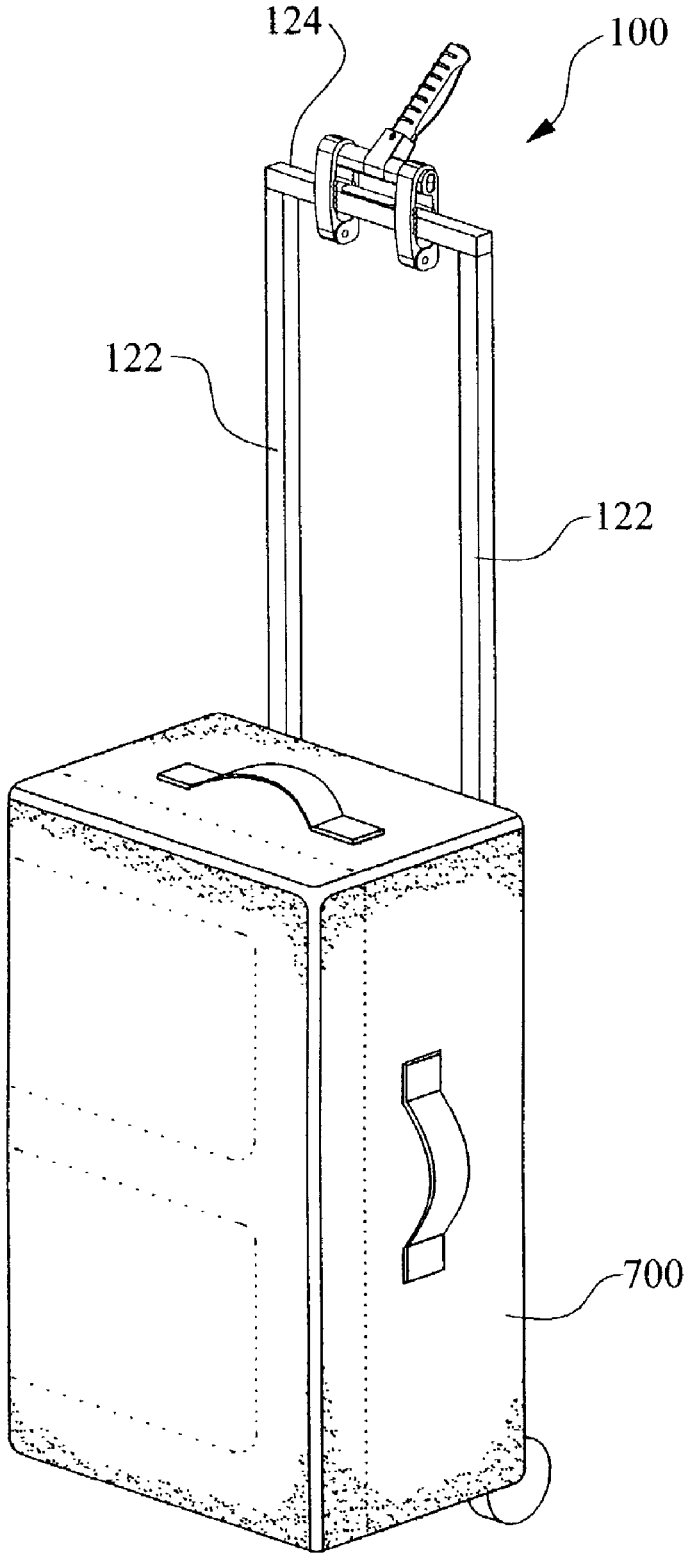
FIG. 7 is a drawing showing another view of the detachable handle system of FIGS. 1*a*–1*c* attached to an article of rolling luggage.

An exemplary embodiment of a first configuration of a detachable handle system 100 is shown in FIGS. 1*a*–1*c*. The handle system includes a grasping bar 102 that has at least one gripping area 103 ergonomically formed for grasping. A releasable securement structure 104 is preferably coupled to the grasping bar 102. The releasable securement structure in this embodiment can be comprised of one or more locking clips 108. As best shown in FIGS. 2*a*–2*c*, the clips 108 are advantageously configured for locking the releasable securement member 104 to an existing handle of a rolling article. For example, the existing handle can be a cross-member 124 mounted between extensible post members 122. An article of luggage 700 with the detachable handle assembly of FIGS. 1*a*–1*c* in place is shown in FIG. 7.

Clips 108 can be of any desired configuration capable of fixedly locking the detachable handle 100 to the cross-member 124 in a manner that will prevent rotation of the detachable handle 100 relative to the cross-member. According to a preferred embodiment, the clips 108 can be of the clamshell variety. In that case, a clip rotatable member 109 can pivot on a pivot element 110 from an open position illustrated in FIGS. 1*a* and 1*b* to a closed position illustrated in FIG. 1*c*. Each clip 108 can have a pair of engagement surfaces 112 for engaging opposing sides of the existing handle defined by cross-member 124. The engagement surfaces 112 are preferably formed of rubber or plastic teeth that can securely grip the cross-member 124 in a fixed manner so as to prevent rotation of the detachable handle 100 relative to the cross-member 124. Interlocking surfaces 114 and 116 can be provided on the clip 108 so that when rotatable member 109 is moved to a closed position as shown in FIG. 1*c*, the interlocking surfaces 114, 116 engage with one another in a locked configuration so as to prevent rotatable member 109 from subsequently returning to an open position.

When in the open position, the clips 108 can be positioned adjacent to a cross-member 124 of an existing luggage handle assembly in the manner illustrated in FIG. 2*a*. Subsequently, clips 108 can be used to engage the cross-member 124 by moving rotatable member 109 to the closed position as illustrated in FIG. 2*b*. When the clips are in the closed configuration as shown in FIG. 2*c*, the releasable securement structure fixedly engages the cross-member 124 of the existing handle so as to prevent rotation of the releasable securement structure 104 relative to the cross-member 124. A clip-release button 118 is preferably provided on each clip 109 so that interlocking surfaces 114, 116 can be released and thereby allow rotatable member 109 to return to its open configuration.

A pivot locking mechanism is preferably provided that is operatively associated with the releasable securement structure 104 and grasping bar 102 for releasably locking the grasping bar 102 in a plurality of pivot positions relative to securement structure and the existing handle of said rolling luggage. The pivot locking mechanism can comprise a lock actuator button 120 provided at a convenient location, for controlling a cooperating mechanical arrangement internal to the grasping bar 102 and securement structure 104. For example, a simple post and slot arrangement could be used for this purpose. A handle bridge assembly 106 is preferably provided that is configured to accommodate axial movement of the grasping bar 102 about the securement structure. Those skilled in the art will appreciate that the invention is not limited to any specific locking mechanism. Instead any of a wide variety of possible arrangements can be used to implement the locking mechanism.

According to a preferred embodiment, the lock actuator button 120 can be positioned on a portion of the grasping bar 102 contiguous to the ergonomic gripping area 103 so as to be conveniently operable by a user's thumb or fingers when a user's fingers are wrapped around the gripping area 103. For example, the lock actuator button 120 can be aligned with a user's thumb when the user's fingers are wrapped around the ergonomic gripping area 103 of elongated bar 102.

FIGS. 2*b* and 2*c* illustrate two possible pivot positions for the grasping bar 102 relative to the securement structure 104. However, it should be understood that the invention is not limited to the two pivot positions shown. Other pivot orientations are also possible and are included within the scope of the invention.

Figures 3A, 3B:
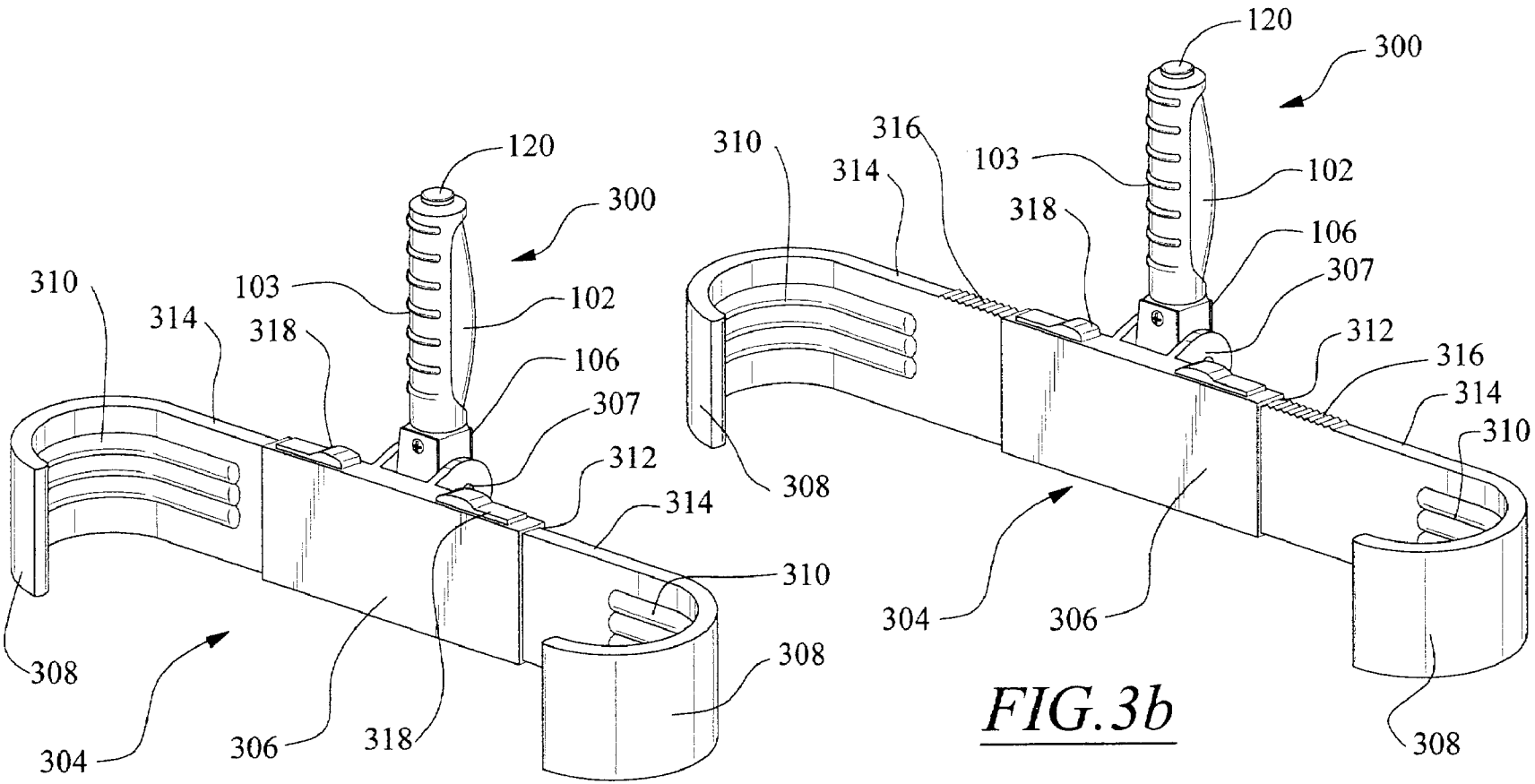
FIGS. 3*a* and 3*b* are a series of drawings that are useful for understanding a second configuration of a detachable handle system.

FIGS. 3*a* and 3*b* are a series of drawings that are useful for understanding a second configuration of a detachable handle system 300 in which an alternative embodiment of the securement structure is provided. Elements in FIGS. 3*a* and 3*b* that are common to those in FIGS. 1 and 2 are identified using like reference numerals. Thus, the grasping bar 102, ergonomic gripping surface 103, bridge assembly 106, and lock actuator button 120 can been seen in FIGS. 3*a*–3*b*.

As shown in FIGS. 3*a*–3*b* and 4*a*–4*c*, a securement structure 304 is provided that is generally configured for engaging a pair of extensible post members 122. Similar to the arrangement previously described relative to FIGS. 1 and 2, the grasping bar 102 is preferably attached to bridge assembly 106 that can pivot about a pivot support 307 to a series of locked pivot positions. A pivot locking mechanism is preferably provided that is operatively associated with the releasable securement structure 304 and grasping bar 102. The pivot locking mechanism is provided for releasably locking the grasping bar 102 in a plurality of pivot positions relative to securement structure 304 and the existing handle of the rolling luggage. The pivot locking mechanism can comprise a lock actuator button 120 provided at a convenient location, for controlling a cooperating mechanical arrangement internal to the grasping bar 102, bridge assembly 106, and securement structure 304. For example, a simple post and slot arrangement could be used for this purpose. Those skilled in the art will appreciate that the invention in FIGS. 3*a*–3*b* is not limited to any specific locking mechanism. Instead any of a wide variety of possible arrangements can be used to implement the locking mechanism.

The securement structure 304 can comprise a rigid frame 306 defining a pair of sleeves 312 for slidably receiving an arm portion 314 of J-shaped clips 308. The J-shaped clips 308 are preferably configured for engaging extensible post members 122 of an existing handle of a rolling luggage article. Rubber gripping material 310 can be provided on a gripping surface of the clips 310 for preventing slippage of the handle system 300 relative to the extensible post members 122 and the cross-member 124.

According to a preferred embodiment, the arm portion 314 of J-shaped clips 308 can be releasably locked within sleeves 312. For example, the arm portions 314 can have a set of teeth 316 that lockingly engage within the rigid frame 306 when arm portions 314 of J-shaped clips 308 are inserted within sleeves 312. According to a preferred embodiment, the sleeve and arm portions 314 can be configured to engage in a ratchet-like manner so that the arm portions 314 can be freely moved from an open configuration as shown in FIG. 3*b* to a closed configuration as shown in FIG. 3*a*, but preferably cannot be retracted from the sleeves without actuating a release button 318.

Figure 4C:
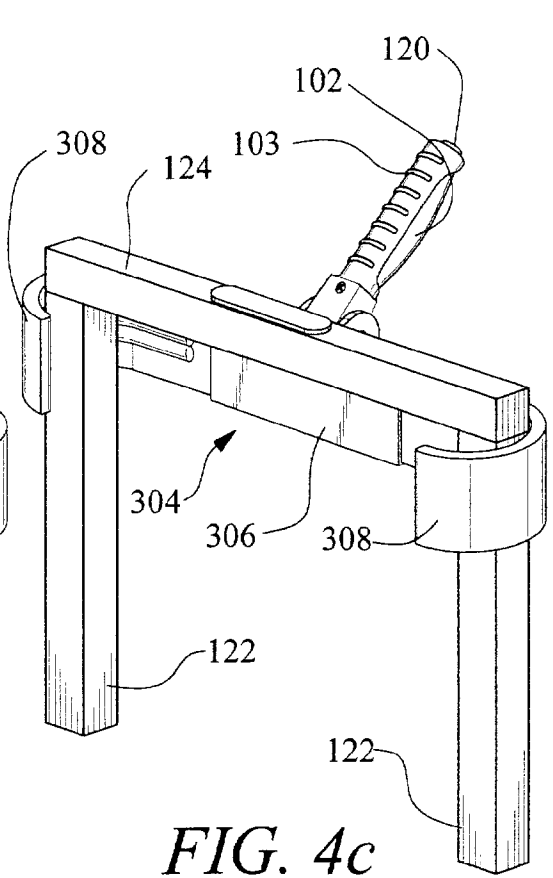
FIGS. 4*a*–4*c* are a series of drawings showing the manner in which the handle system of FIGS. 3*a* and 3*b* can be attached to an article of rolling luggage.
Figure 4B:
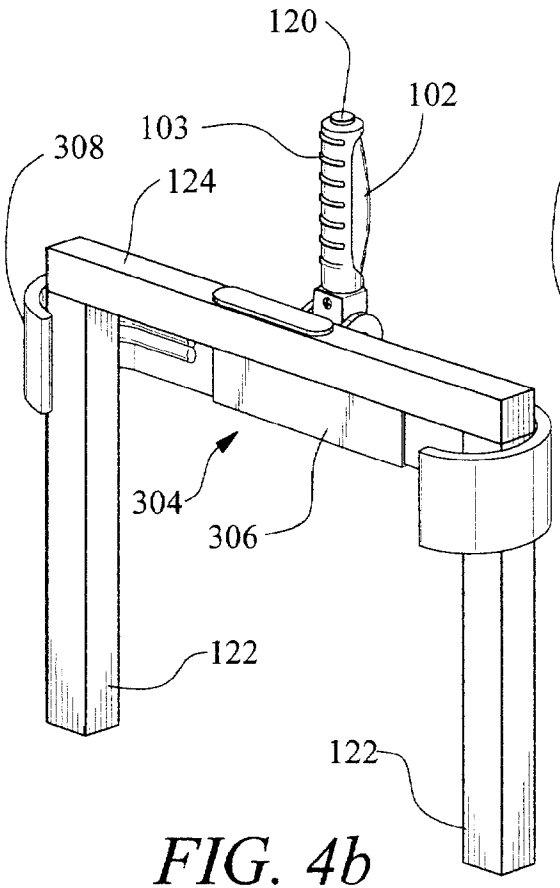
Figure 4A:
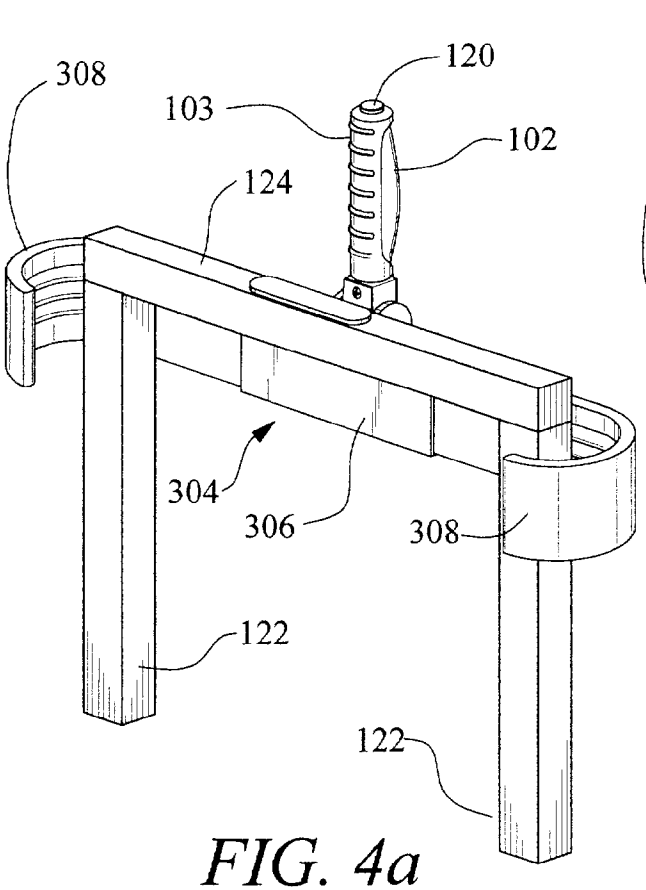

FIGS. 4*a*–4*c* are a series of drawings showing the manner in which the handle system of FIGS. 3*a* and 3*b* can be attached to an article, such as an article of rolling luggage. As illustrated in FIG. 4*a*, the handle system can be positioned in an open configuration adjacent to an existing handle of an article of luggage comprising extensible post members 122 and cross-member 124. Subsequently, the J-shaped clips can be caused to securely engage the extensible post members 122 as shown in FIG. 4*b* by exerting pressure on each of the J-shaped clips 308 in a direction toward the grasping bar 102. Once the J-shaped clips 308 have securely engaged the extensible post members 122, the handle system 300 is secured to the article of luggage and is prevented from freely rotating relative to the existing handle. However, by using the lock actuator button 120, the grasping bar 102 can be released from the securement structure 304 to pivot to a plurality of different positions where it can be locked in position. FIGS. 4*b* and 4*c* show two such pivot positions, but those skilled in the art will appreciate that the invention is not so limited.

Figure 5:
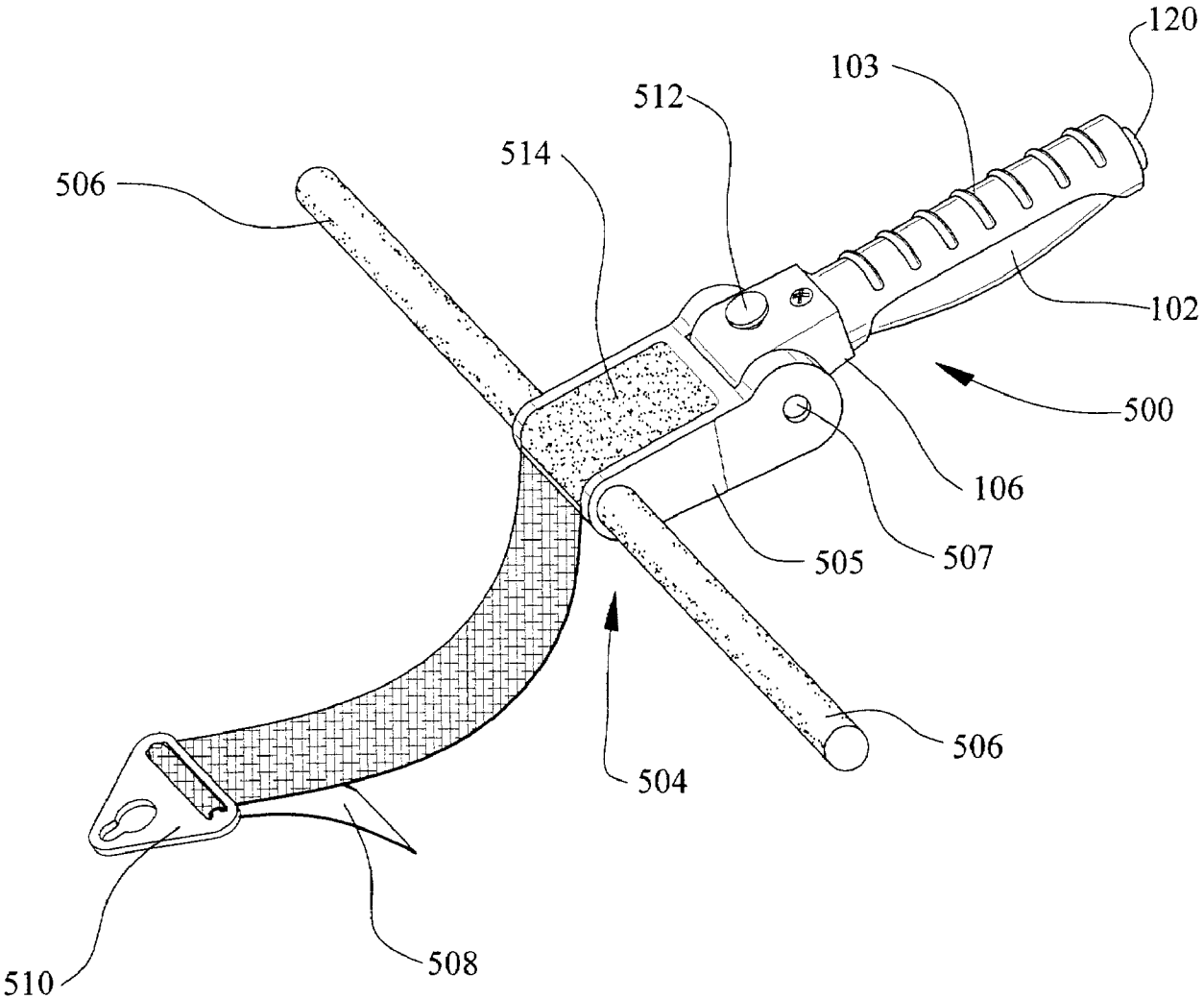
FIG. 5 is a drawing that is useful for understanding a third configuration of a detachable handle system.
Figure 6C:
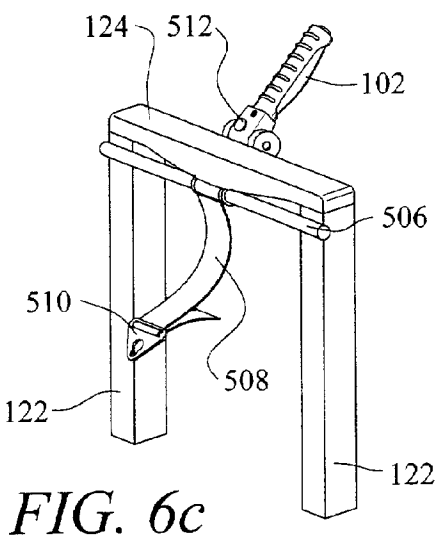
FIGS. 6*a*–6*e* are a series of drawings that are useful for understanding the manner in which the handle system of FIG. 5 can be attached to an article of rolling luggage.
Figure 6B:
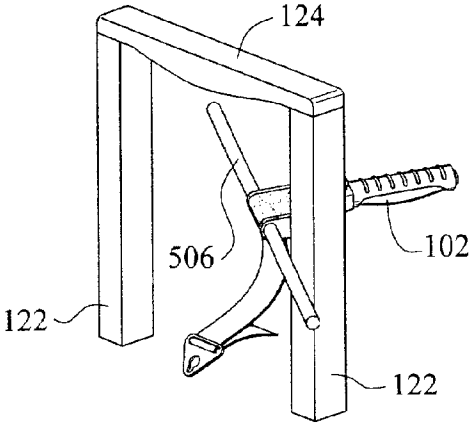
Figure 6A:
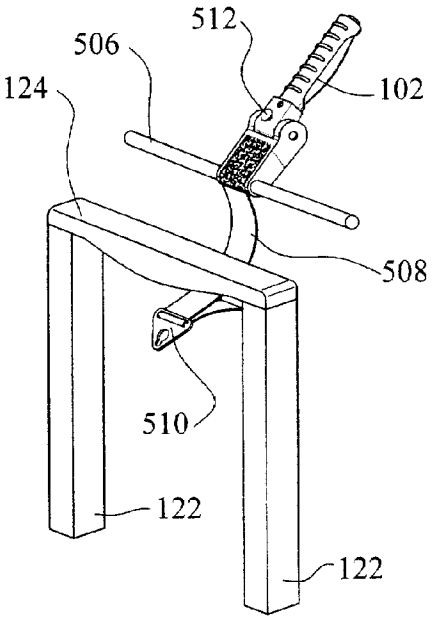
Figure 6E:
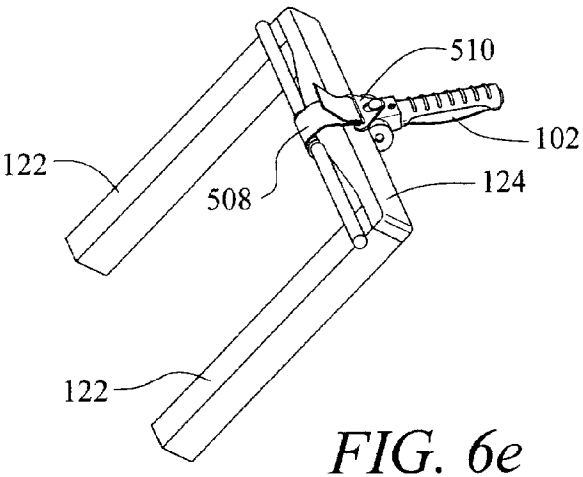
Figure 6D:
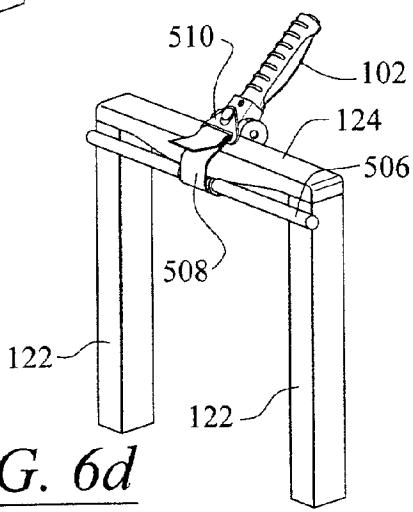

FIG. 5 is a drawing that is useful for understanding a third configuration of a detachable handle system 500 according to a preferred embodiment of the present invention. Elements in FIG. 5 that are common to those in FIGS. 1–4 are identified using like reference numerals. Thus, the grasping bar 102, ergonomic gripping surface 103, bridge assembly 106, and lock actuator button 120 are shown in FIG. 5. According to a preferred embodiment, the handle system 500 has a securement structure 504 that is comprised of a housing 505 and rod members 506.

The housing 505 is preferably provided with an engagement surface 514. The engagement surface can be flat or shaped so as to mate with a surface of a handle cross-member 124 as shown in FIGS. 6*a*–6*e*. The engagement surface can be formed of rubber, plastic or other suitable material so as to prevent scratching or marring of an existing handle of a luggage article. The rod members 506 extend transversely from the housing 505 and are preferably of sufficient length so as to be at least as long as the distance between the extensible post members 122 of an existing handle assembly as illustrated in FIGS. 6*a*–6*e*.

A pivot support 507 is supported within the frame 505 and within the bridge assembly 106 to facilitate pivoting of the grasping bar 102 relative to housing 505. The grasping bar can advantageously pivot to a series of locked pivot positions about the pivot support 507. According to a preferred embodiment, a strap 508 can be provided formed of a flexible material, such as nylon webbing. The strap is preferably attached to the housing 505 or some other portion of the securement structure 504 so that it can loop around a cross-member 124 of an existing handle assembly as shown in FIGS. 6*a*–6*e*. Latch 510 is adjustably attached to the strap 508 so that it can be moved to different positions along the length of the strap and thereafter secured in such position to accommodate handle cross-members 124 of differing diameter. A clip 512 can be provided on an opposing side of the securement structure 504. For example, the clip 512 can be positioned on the bridge assembly 106 as shown in FIG. 5. The latch 510 can be secured to the clip 512 so as to fix the securement structure 504 to the existing handle in a manner that prevents rotation of the detachable handle assembly 500 relative to the existing structure. FIGS. 6*a*–6*e* illustrate the process by which the handle assembly 500 can be positioned between the extensible posts 122 of the existing handle assembly and thereafter secured to a cross-member 124.

Figure 8A:
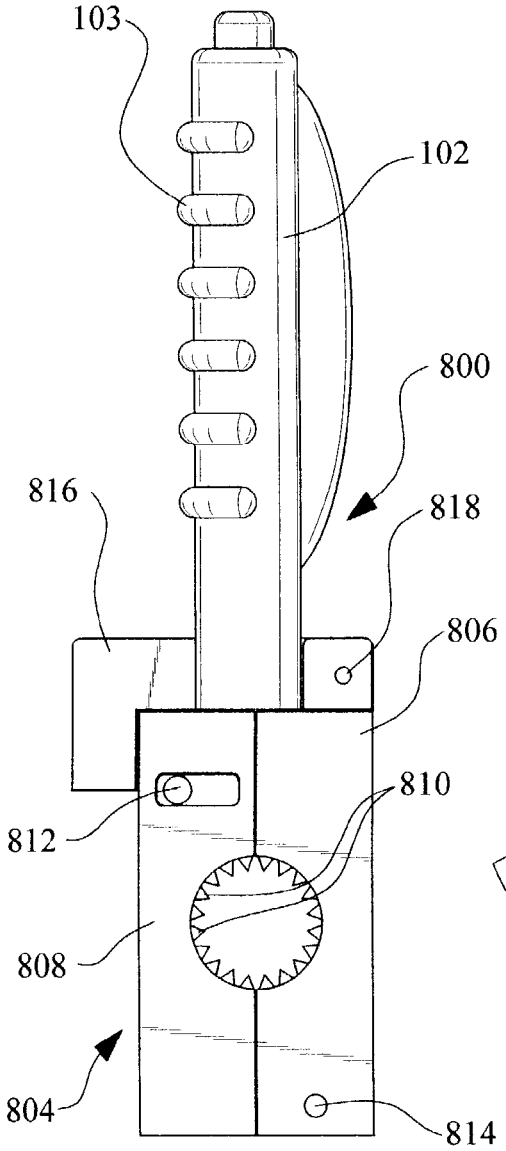
FIG. 8*a*–8*d* are a side view series of drawings that are useful for understanding a fourth configuration of a detachable handle system.
Figure 8B:
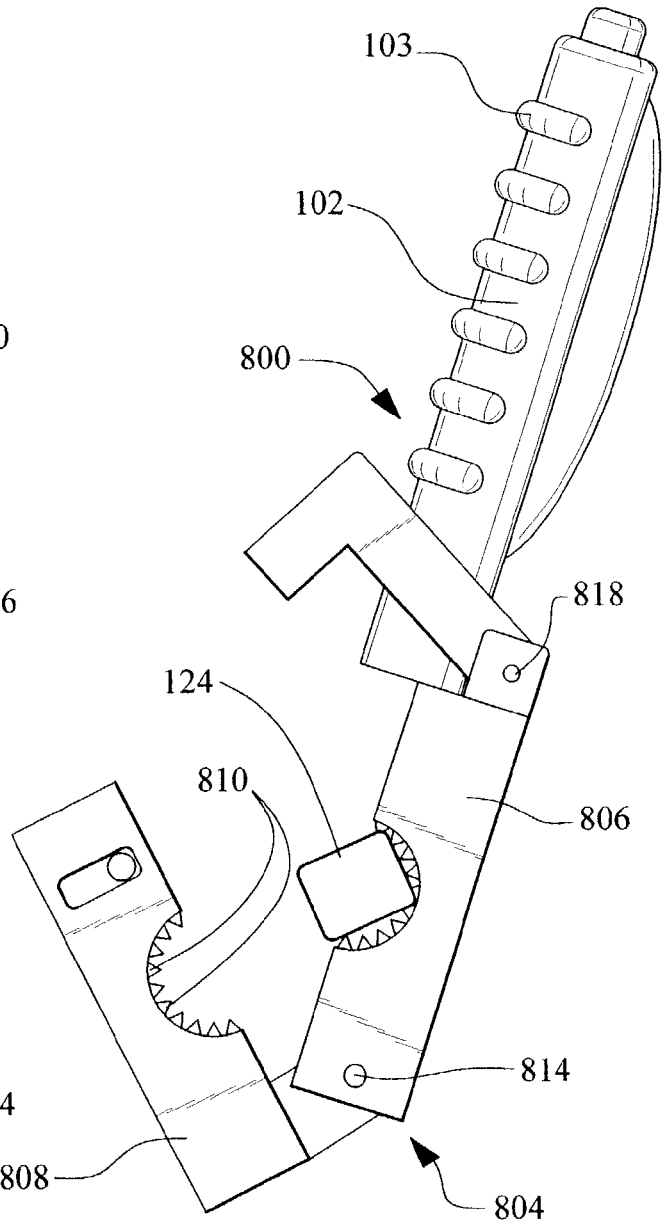
Figure 8C:
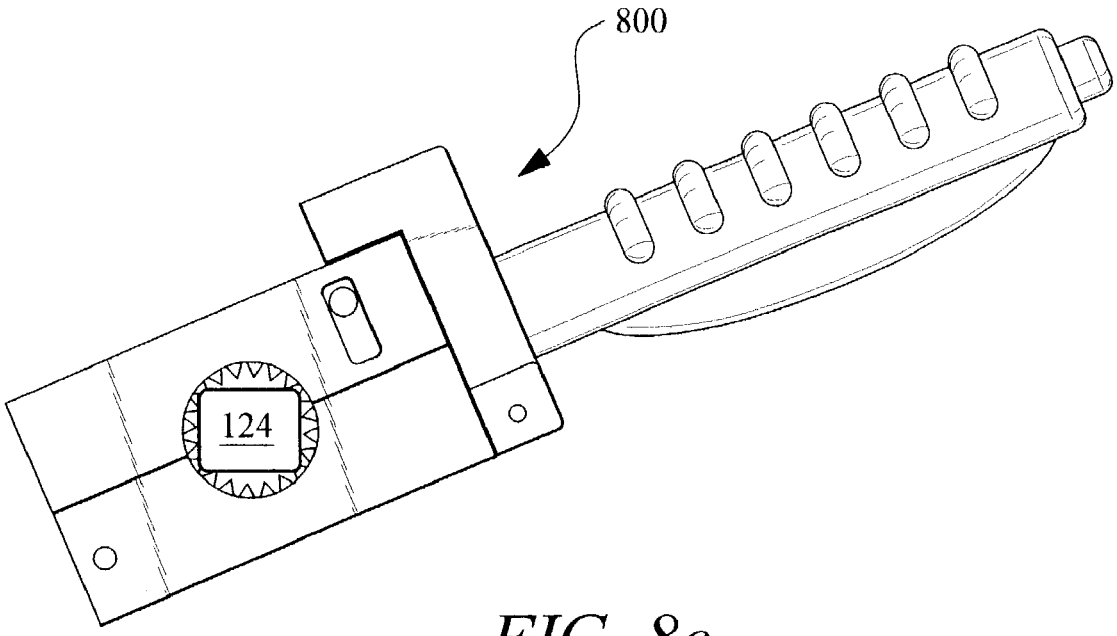
Figure 8D:
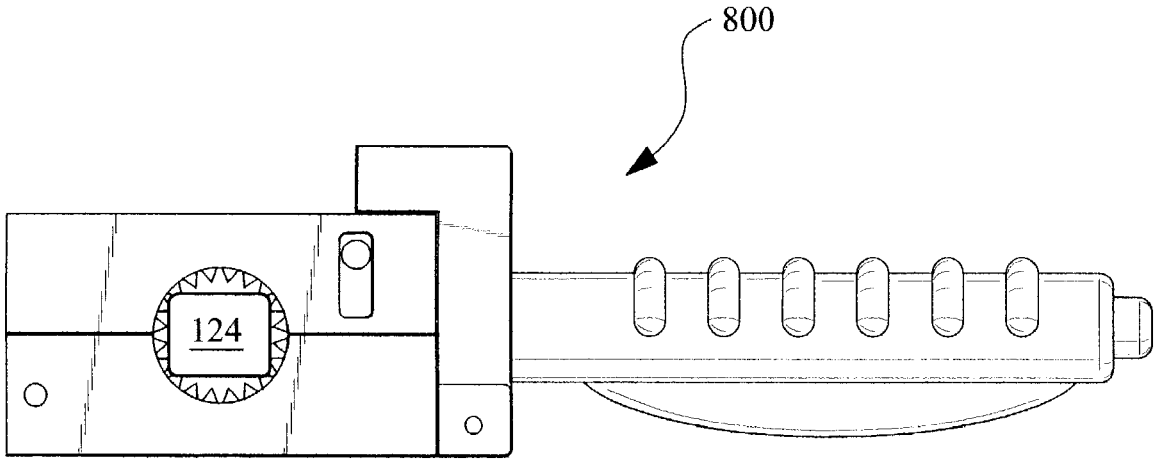
Figure 9:
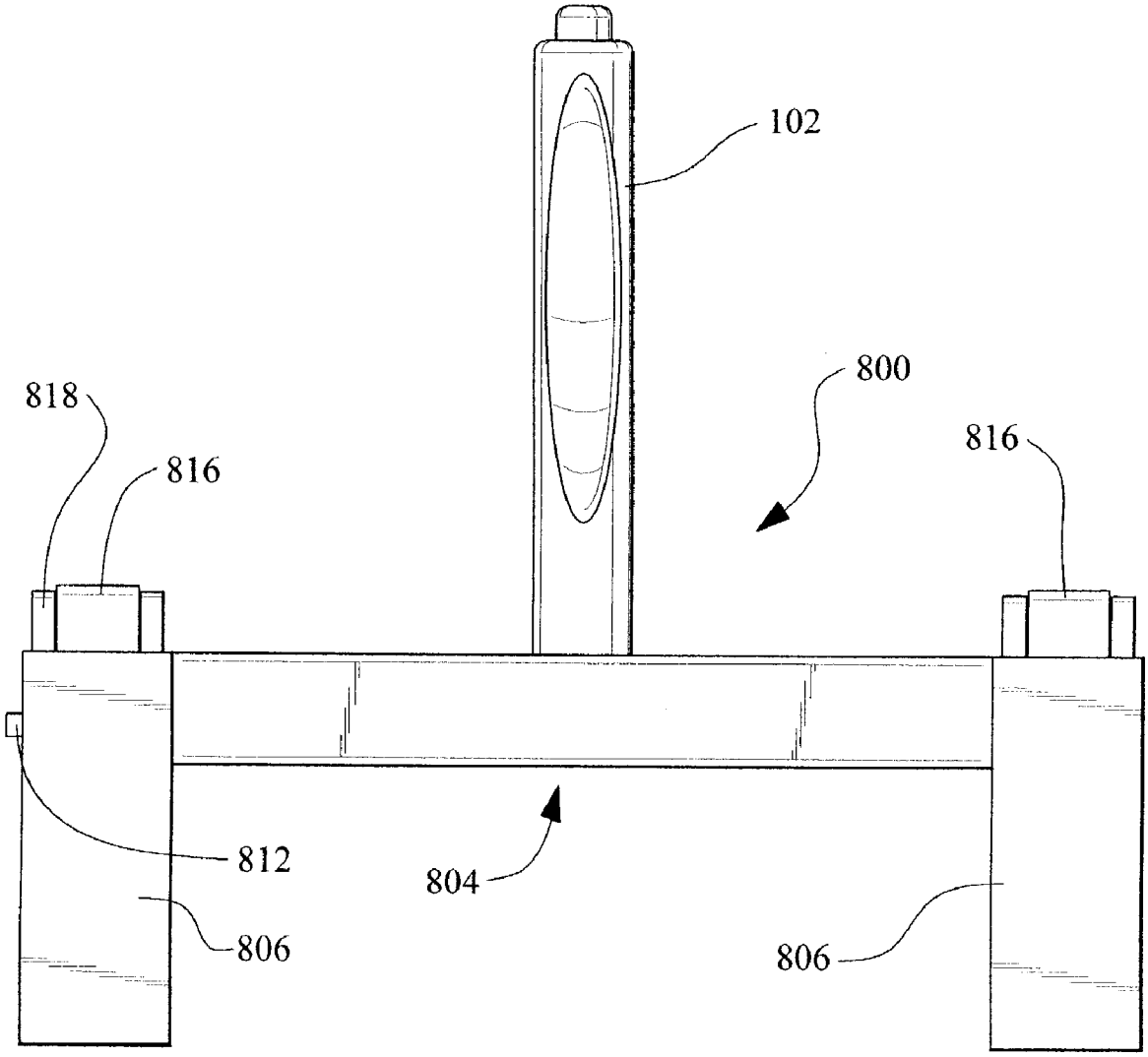
FIG. 9 is a front view of the detachable handle system of FIG. 8.

FIGS. 8*a* and *b* are a side view series of drawings that are useful for understanding a fourth configuration of a detachable handle system 800. Elements that are common to those in FIGS. 1–4 are identified using like reference numerals. Thus, the grasping bar 102 and ergonomic gripping surface 103 are shown in FIGS. 8*a* and 8*b*. A front view of the detachable handle system is shown in FIG. 9. As shown in FIGS. 8*a*, 8*b* and 9, securement structure 804 is provided rigidly attached to the grasping bar 102. The securement structure is configured for engaging an existing handle of an article of luggage in a plurality of pivot orientations such that the handle 800 cannot rotate relative to the existing handle of an article of luggage. For example, two pivot orientations are illustrated in FIGS. 8*c* and 8*d*. The handle 800 can be any suitable arrangement for releasably securing the handle system 800 in a particular pivot orientation relative to the existing handle system of an article of luggage.

For example, as illustrated in FIGS. 8*a* and 8*b*, the handle system 800 can be comprised of first and second clasp members 806 and 808 respectively that are joined by a hinge 814. Each of the first and second clasp members can be moved from a closed position shown in FIG. 8*a* to an open position illustrated in FIG. 8*b*. A latch arm 816 attached to hinge 818 is provided to secure the clasp members in the closed configuration of FIG. 8*a*. A latch release actuator 912 is provided for releasing the latch.

A series of corrugated teeth 810 can be formed in each of the clasp members 806, 808 for fixedly engaging a cross-member 124 of an existing handle of an article of luggage. The teeth 810 are preferably formed from a hard rubber or plastic material that is sufficiently rigid to fixedly maintain the handle 800 in a particular pivot orientation relative to cross-member 124. However, the teeth 810 are also preferably sufficiently soft so as to conform somewhat to the shape of the cross-member 124 to engage the existing handle in any pivot orientation without scratching or marring.

Figures 10A, 10B, 10C:
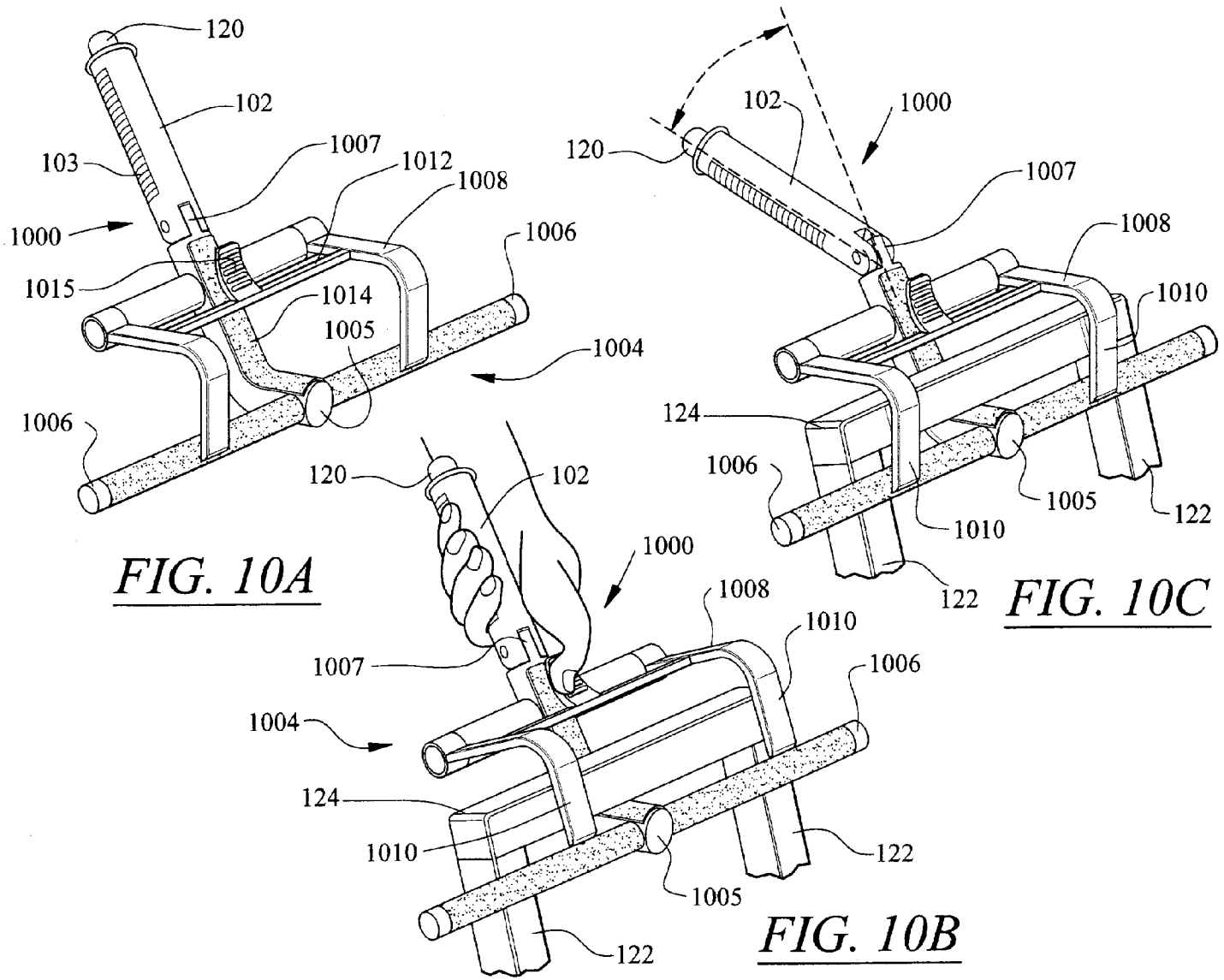
FIGS. 10*a*–10*c* are a series of perspective view drawings that are useful for understanding a fifth configuration of a detachable handle system.
Figure 11A:
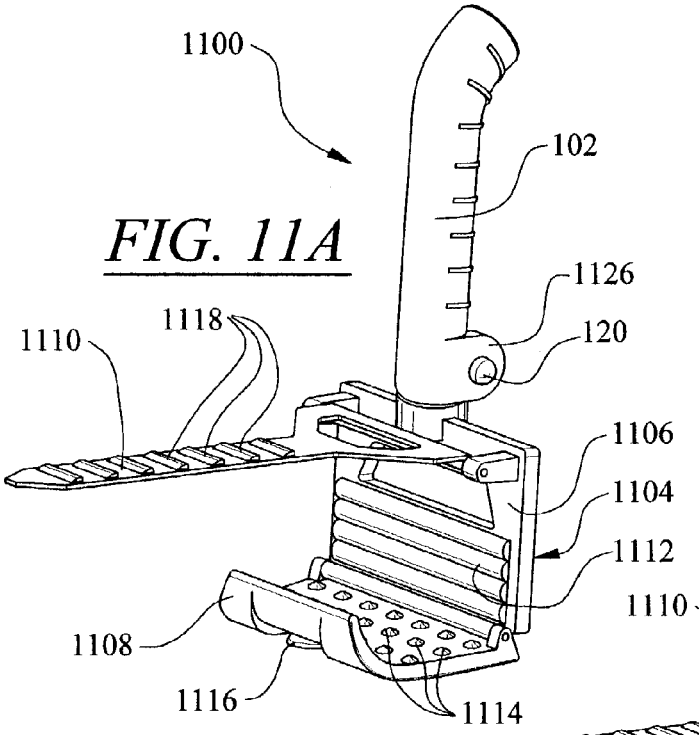
FIGS. 11*a*–11*c* are a series of perspective view drawings that are useful for understanding a fifth configuration of a detachable handle system.
Figure 11B:
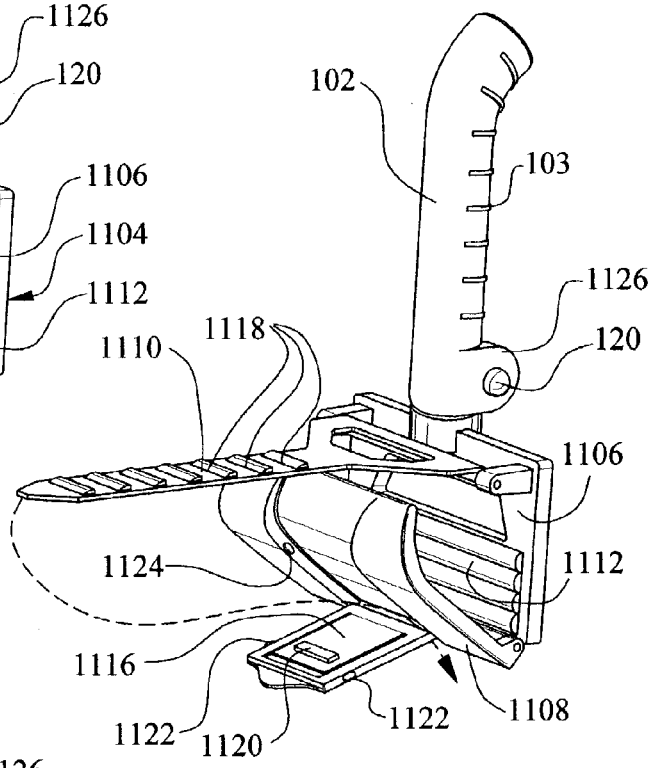
Figure 11C:
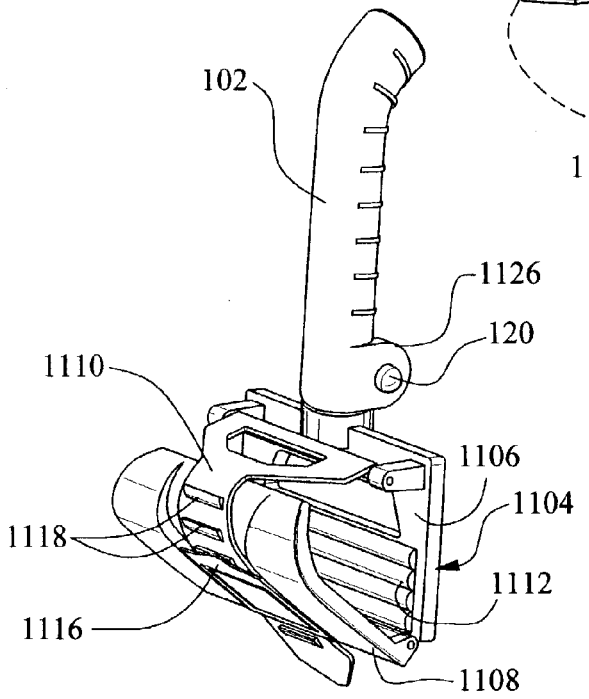

FIGS. 10*a*–10*c* show a further alternative configuration for the detachable handle assembly of the referenced invention. Elements in FIGS. 10*a*–10*c* that are common to those in FIGS. 1–8 are identified using like reference numerals.

Thus, the grasping bar 102, ergonomic gripping surface 103, and lock actuator button 120 are shown in FIGS. 10*a*–10*c*. According to a preferred embodiment, the handle system 1000 has a securement structure 1004 that is comprised of a frame 1005 and rod members 1006.

The frame 1005 is preferably provided with an engagement surface 1014. The engagement surface 1014 can be flattened or shaped so as to mate with a surface of a handle cross-member 124 as shown in FIGS. 10*a*–10*c*. The engagement surface 1014 can be formed of rubber, plastic or other suitable material so as to prevent scratching or marring of an existing handle cross-member 124 of a luggage article. The rod members 1006 extend transversely from the frame 1005 and are preferably of sufficient length so as to be at least as long as the distance between the extensible post members 122 of an existing handle assembly as illustrated in FIGS. 10–10*c*.

A pivot support 1007 is provided on the frame 1005 to facilitate pivoting of the grasping bar 102 relative to the frame 1005. As shown in FIG. 10*c*, the grasping bar 102 can advantageously pivot to a series of locked pivot positions about the pivot support 1007. For example, the lock actuator button 120 can be used to releasably engage a pin (not shown) within the pivot support 1007.

A spring clip 1008 with arms 1010 is pivotally attached to the frame 1005. The spring clip is preferably resiliently biased so that the arms 1010 will exert a force directed toward the engagement surface 1014 of frame 1005. This can be accomplished, for example, using a spring internal to the clip 1008. A control bar 1012 can also be provided attached to the spring clip for selectively operating the spring clip. For example, by exerting pressure on an actuator tab 1015 as shown in FIG. 10*b*, the spring clip can be moved to an open position for insertion of a cross-member 124. The arms 1010 can be advantageously configured with an L-shape for more securely engaging a cross-member 124 of an existing handle of a luggage article.

The securement structure 1004 can be releasably attached to an existing handle of a rolling luggage article in the manner illustrated in FIGS. 10*b* and 10*c*. The actuator tab 1015 is depressed as shown in FIG. 10*b* to open the spring clip. This action allows for the cross-member 124 of the existing handle to be positioned between the rod members 1006 and arms 1010 of the spring clip. The securement structure is positioned so that rod members 1006 engage post members 122 as shown in FIG. 10*b*. The existing handle is positioned so that the cross-member 124 rests against the engagement surface 1014 of the frame 1005. Thereafter, pressure on the spring clip can be released so that the arms 1010 secure the cross-member 124 to the engagement surface 1014 as shown in FIG. 10*c*.

FIGS. 11*a*–11*c*, 12*a*–12*c*, 13, 14 and 15*a*–15*b* show a further alternative configuration for the detachable handle assembly of the referenced invention. Elements in FIGS. 11*a*–15*b* that are common to those in FIGS. 1–8 are identified using like reference numerals. Thus, the grasping bar 102, ergonomic gripping surface 103, and lock actuator button 120 are shown in FIGS. 11*a*–11*c*, 12*a*–12*c*, and 13. According to the illustrated embodiment, the handle system 1100 has a securement structure in the form of a locking clip 1104. The locking clip 1104 may have a base member 1106, a rotatable clip portion 1108 pivotally connected to the base member 1106, and a securement strap 1110.

Figure 12A:
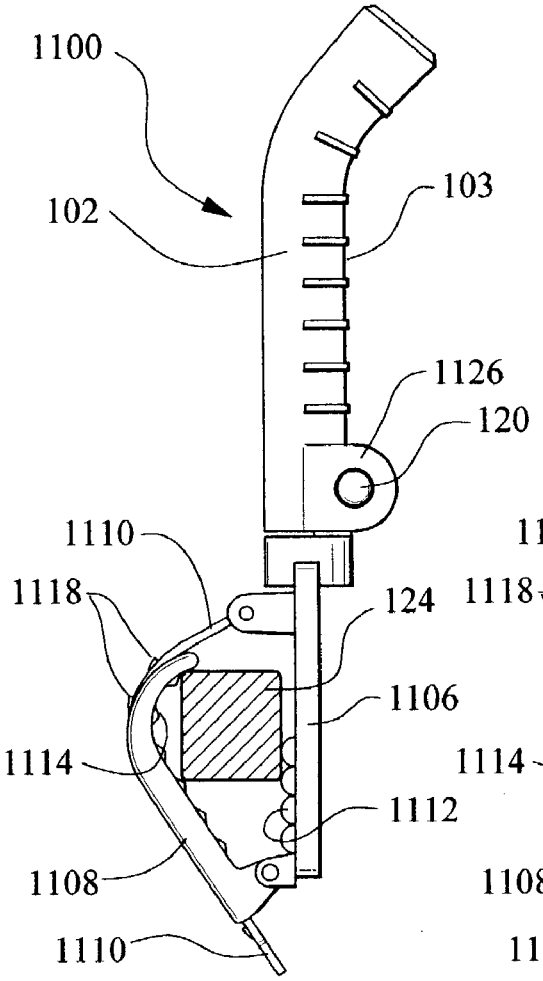
FIGS. 12*a*–12*c* are a series of drawings showing the manner in which the handle system of FIGS. 11*a*–11*c* can be attached to an article of rolling luggage.
Figure 12B:
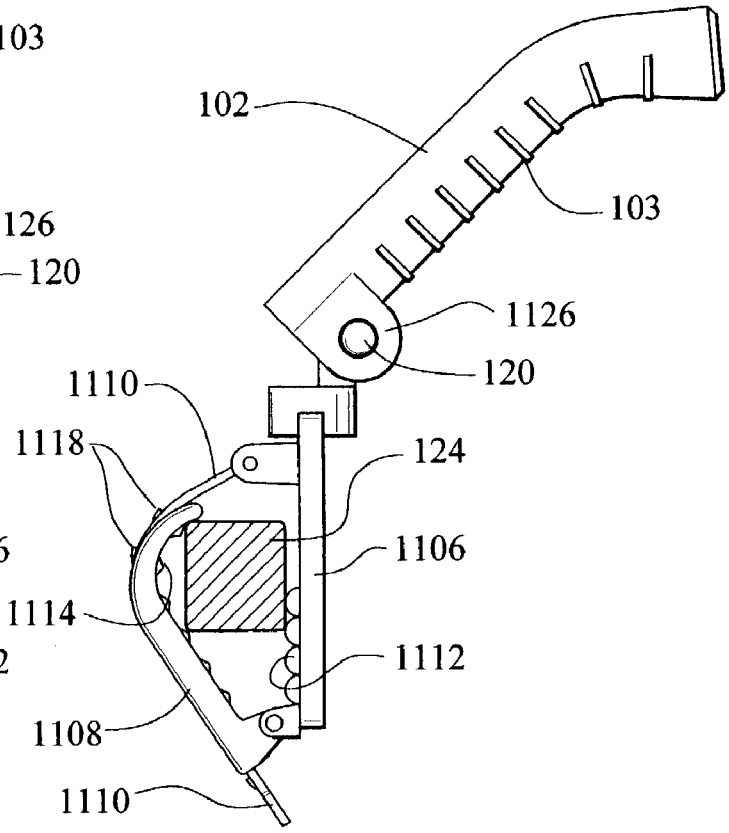
Figure 12C:
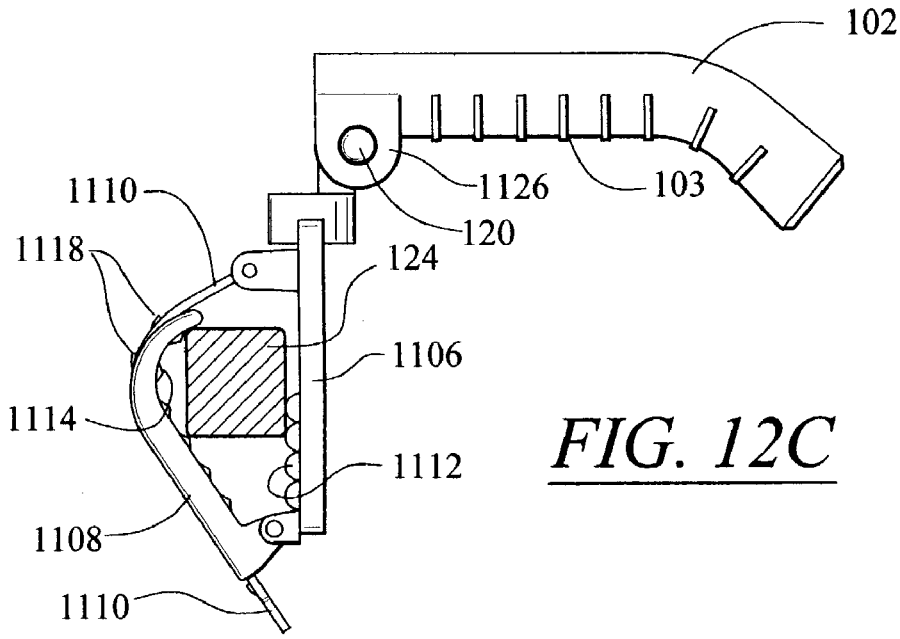
Figure 13:
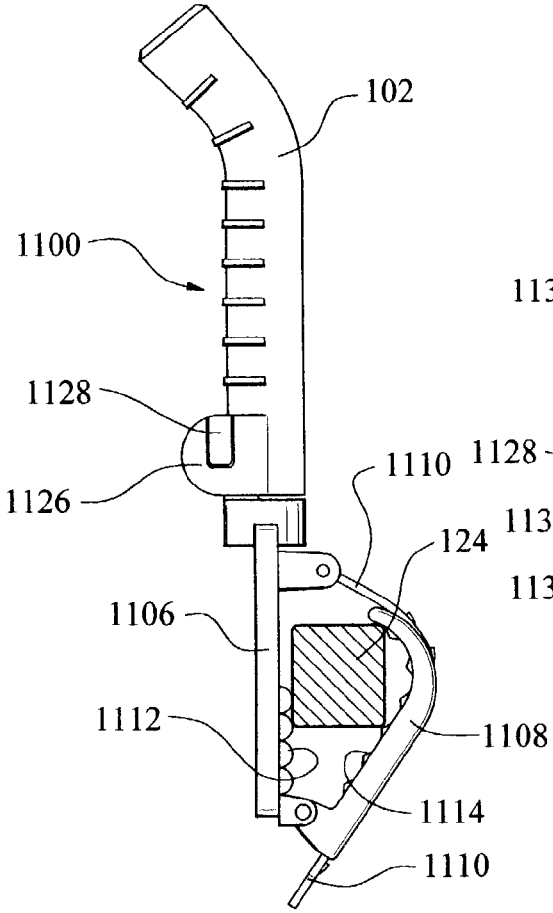
FIG. 13 is a side view of the handle system of FIGS. 11*a*–11*c*.
Figure 14:
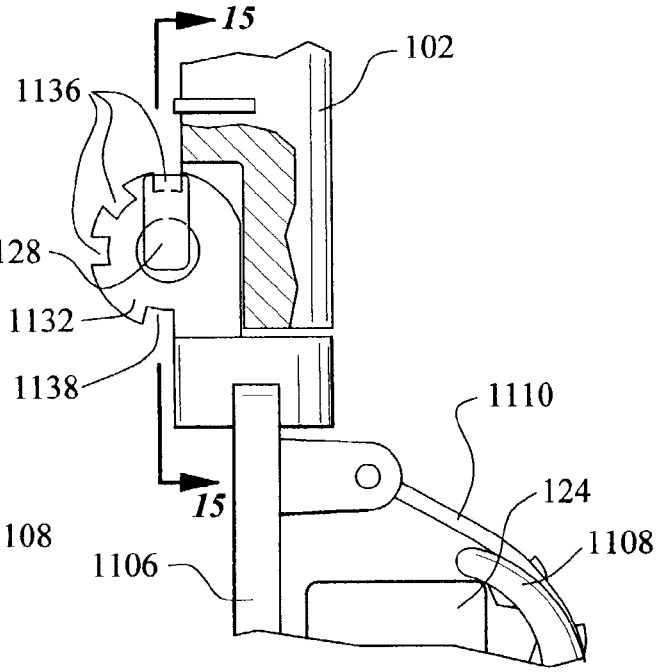
FIG. 14 is an enlarged, part-sectional view of part of FIG. 13.
Figure 15A:
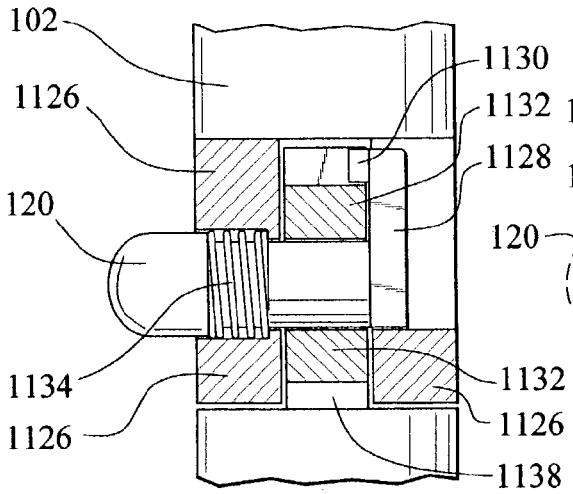
FIGS. 15*a*–15*b* are sectional views along line 15—15 of FIG. 14 showing the locking mechanism of the illustrated handle system in different configurations.
Figure 15B:
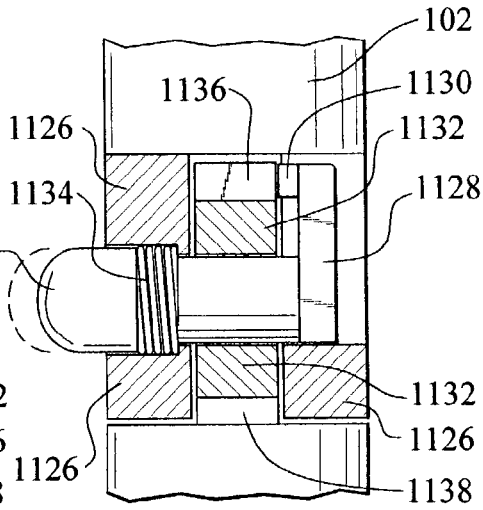

The base member 1106 is preferably provided with an engagement surface 1112. The engagement surface 1112 can be shaped so as to mate with a surface of a handle cross-member 124 as shown in FIGS. 12*a*–12*c*. The engagement surface 1112 can be formed of rubber, plastic or other suitable material so as to prevent scratching or marring of an existing handle cross-member 124 of a luggage article. In the illustrated embodiment, the engagement surface 1112 is provided with engagement ridges, although it will be appreciated that any suitable configuration may be employed. Similarly, the clip portion 1108 is preferably provided with an engagement surface 1114. In the illustrated embodiment, the engagement surface 1114 includes a plurality of raised cones, but any suitable configuration may be employed. The clip portion 1108 may be curved to accommodate a handle cross-member 124 of a luggage article between the clip portion 1106 and the base member 1106.

The strap 1110 may be pivotally connected to and extend from an upper part of the base member 1106, and may be releasably secured to the clip portion 1108 by a buckle 1116 provided on the clip portion 1108. The strap 1110 is preferably formed of a flexible material, such as nylon webbing, leather, rubber, plastic or any other suitable material. The buckle 1116 may have any suitable configuration for grasping the strap 1110. In the illustrated embodiment, the strap 1110 has a plurality of ridges 1118, and the buckle 1116 has a projection 1120 that may engage one of the ridges 1118. The buckle 1116 may be clipped into a securement position by side projections 1122 which engage in corresponding side depressions 1124 in clip portion 1108. One of ordinary skill in the art will recognize that any suitable buckle or attachment configuration may be used to secure the strap 1110 to the clip portion 1108. The strap 1110 enables the clip portion 1108 to be secured around different cross-members 124 having different sizes, thus enabling the handle assembly to be used with a plurality of different articles of luggage.

A pivot locking mechanism is preferably provided that is operatively associated with the releasable securement structure 1104 and grasping bar 102 for releasably locking the grasping bar 102 in a plurality of pivot positions relative to securement structure and the existing handle of said rolling luggage. The pivot locking mechanism can comprise a lock actuator button 120 provided at a convenient location, for controlling a cooperating mechanical arrangement internal to the grasping bar 102 and securement structure 1104. The lock actuator button 120 may be provided in a hub 1126 located at the base of the grasping bar 102, as shown in FIGS. 11*a*–11*c* and 12*a*–12*c*, or may be provided at any other convenient location. The lock actuator button 120 may operate a slider 1128. The slider 1128 may include a projection 1130 that can cooperate with a gear 1132 connected to the base member 1106. The gear 1132 may be pivotally connected to the hub 1126. The lock actuator button may include a spring 1134 to bias the button 120 into a position in which the projection 1130 is engaged with the gear 1132, as shown in FIG. 5*a*. Depression of the lock actuator button 120, as shown in FIG. 5*b*, moves the slider 1128 such that projection 1130 is no longer engaged with gear 1132. This enables the grasping bar 102 to be pivoted around the gear 1132 until the slider 1128 can engage a different part of the gear portion 1132. The grasping bar 102 may thus be pivoted into a plurality of different positions for ease of maneuverability of the article the handle system is attached to. In the illustrated embodiment, the gear 1132 has three upper teeth 1136, enabling the grasping bar 102 to be secured in three positions, as illustrated in FIGS. 12*a*–12*c*. In addition, the gear 1132 has one lower tooth 1138, enabling the handle system to be folded for storage. Any suitable configuration of teeth may be employed.

We claim:

1. A handle system for removable attachment to an existing handle of a rolling luggage case, comprising:

a grasping bar, said grasping bar having a gripping area ergonomically formed for grasping;

a releasable securement structure coupled to said grasping bar, said releasable securement structure comprised of a base member, a clip portion pivotally connected to a portion of said base member, and a securement strap;

said base member having a base engagement surface adapted for engaging a first portion of said existing handle of said rolling luggage case, said clip portion having a clip engagement surface adapted for engaging a second portion of said existing handle when said clip portion is pivoted toward said base member;

a locking mechanism operatively associated with said releasable securement structure for locking said grasping bar in a plurality pivot positions relative to said securement structure; and wherein said securement strap is releasably secured between said base member and said clip portion, and a tension applied to said securement strap forces said clip engagement surface toward said base engagement surface for locking said existing handle to said securement structure.

2. A handle system for removable attachment to an existing handle of a rolling luggage case, comprising:

a grasping bar, said grasping bar having a gripping area ergonomically formed for grasping;

a releasable securement structure coupled to said grasping bar, said releasable securement structure configured for releasably securing said grasping bar to said existing handle of said rolling luggage case at an end thereof distal from said luggage case;

said releasable securement structure comprised of a base member, a clip portion pivotally connected to a portion of said base member, and a securement strap, extending between said clip portion and said base member, and wherein a length of said securement strap extending between said base member and said clip portion is adjustable by means of a buckle;

a locking mechanism operatively associated with said releasable securement structure for locking said grasping bar in a plurality pivot positions relative to said securement structure; and wherein said pivot positions of said grasping bar define a plane that is generally parallel to a rolling direction defined by an orientation of a set of wheels of said rolling luggage case.

3. A handle system for removable attachment to an existing handle of a rolling luggage case, comprising:

a grasping bar, said grasping bar having a gripping area ergonomically formed for grasping;

a releasable securement structure coupled to said grasping bar, said releasable securement structure configured for releasably securing said grasping bar to said existing handle of said rolling luggage case at an end thereof distal from said luggage case;

a locking mechanism operatively associated with said releasable securement structure for locking said grasping bar in a plurality pivot positions relative to said securement structure; and wherein said locking mechanism has a pivot lock control actuator disposed on a portion of said grasping bar contiguous with a portion of said gripping area.

4. The handle system according to claim 3 wherein said pivot lock control actuator is aligned for operation by a users thumb when grasping said gripping area.

5. The handle system according to claim 3 wherein said pivot lock control actuator is a button aligned coaxial to said grasping bar.

6. The handle system according to claim 3 wherein said lock control actuator is located at an end of said grasping bar distal from said releasable securement structure.

7. A handle system for removable attachment to an existing handle of a rolling luggage case, comprising:

a grasping bar, said grasping bar having a gripping area ergonomically formed for grasping;

a releasable securement structure coupled to said grasping bar, said releasable securement structure configured for releasably securing said grasping bar to said existing handle of said rolling luggage case at an end thereof distal from said luggage case;

a locking mechanism operatively associated with said releasable securement structure for locking said grasping bar in a plurality pivot positions relative to said securement structure; and wherein said releasable securement structure is comprised of at least one locking clip configured for locking said releasable securement member to said existing handle in a fixed position, and wherein said at least one locking clip comprises a strap and a buckle.

8. The handle system according to claim 7 wherein said at least one locking clip is configured for engaging a cross-member connecting distal end portions of two post members forming said existing handle of said rolling luggage case.

9. A handle system for removable attachment to an existing handle of a rolling luggage case, comprising:

a grasping bar, said grasping bar having a gripping area ergonomically formed for grasping;

a releasable securement structure coupled to said grasping bar, said releasable securement structure comprised of a base member, a clip portion pivotally connected to a portion of said base member, and a securement strap;

said base member having a base engagement surface adapted for engaging a first portion of said existing handle of said rolling luggage case, said clip portion having a clip engagement surface adapted for engaging a second portion of said existing handle when said clip portion is pivoted toward said base member;

said securement strap extending from said base member to said clip portion, and secured by a buckle, said buckle configured for locking said securement strap in a plurality positions along a length of said securement strap, wherein a position of said clip engagement surface opposed from said base engagement surface can be adjusted for securely grasping said existing handle in a fixed position relative to said securement structure;

a locking mechanism operatively associated with said releasable securement structure for locking said grasping bar in a plurality pivot positions relative to said existing handle.

10. A handle system for removable attachment to an existing handle of a rolling luggage case, comprising:

a grasping bar, said grasping bar having a gripping area ergonomically formed for grasping;

a releasable securement structure coupled to said grasping bar, said releasable securement structure configured for releasably securing said grasping bar to said existing handle of said rolling luggage case at an end thereof distal from said luggage case;

a looking mechanism operatively associated with said releasable securement structure for locking said grasping bar in a plurality pivot positions relative to said existing handle; and wherein said releasable securement structure is comprised of at least one releasable securement structure for engaging said existing handle of said rolling luggage in a plurality of orientations prevent relative movement of said grasping bar with respect to said existing handle said releasable securement structure comprised of a base member, a clip portion pivotally connected to a portion of said base member, and a securement strap;

said base member having a base engagement surface adapted for engaging a first portion of said existing handle of said rolling luggage case, said clip portion having a curved clip engagement surface adapted for engaging a second portion of said existing handle when said clip portion is pivoted toward said base member;

said securement strap extending from said base member to said clip portion, and secured by a buckle.

* * * * *

UNITED STATES PATENT AND TRADEMARK OFFICE

CERTIFICATE OF CORRECTION

PATENT NO. : 6,961,978 B2
APPLICATION NO. : 10/359887
DATED : November 8, 2005
INVENTOR(S) : Earley et al.

It is certified that error appears in the above-identified patent and that said Letters Patent is hereby corrected as shown below:

Column 11
Claim 10, line 3, delete “looking” and replace with --locking--.

Signed and Sealed this

Ninth Day of October, 2007

JON W. DUDAS
*Director of the United States Patent and Trademark Office*